US008602595B2

(12) United States Patent
Blanco et al.

(10) Patent No.: US 8,602,595 B2
(45) Date of Patent: Dec. 10, 2013

(54) MOUNTING ARRANGEMENT FOR LIGHTING MODULES AND CORRESPONDING METHOD

(75) Inventors: Francesco Blanco, Spinea (IT); Alessandro Bizzotto, Castelfranco Veneto (IT); Giovanni Scilla, Regensburg (DE); Alessandro Scordino, Dolo (IT)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 829 days.

(21) Appl. No.: 12/609,024

(22) Filed: Oct. 30, 2009

(65) Prior Publication Data

US 2010/0110680 A1 May 6, 2010

(30) Foreign Application Priority Data

Oct. 31, 2008 (EP) ..... 08168026

(51) Int. Cl.
*F21S 4/00* (2006.01)

(52) U.S. Cl.
USPC ..... 362/249.06; 362/241; 362/249.02; 362/239; 362/294

(58) Field of Classification Search
USPC ..... 362/241, 249.02, 249.06, 239, 294
See application file for complete search history.

(56) References Cited

U.S. PATENT DOCUMENTS

| | | | | |
|---|---|---|---|---|
| 5,442,529 | A * | 8/1995 | Hoover | 362/119 |
| 5,944,463 | A | 8/1999 | Savage, Jr. | |
| 2003/0156416 | A1 | 8/2003 | Stopa et al. | |
| 2005/0152133 | A1* | 7/2005 | Kao et al. | 362/155 |
| 2005/0237175 | A1* | 10/2005 | Paulson et al. | 340/479 |
| 2006/0078266 | A1* | 4/2006 | Wu et al. | 385/146 |
| 2007/0190845 | A1* | 8/2007 | Mrakovich et al. | 439/404 |
| 2007/0217192 | A1 | 9/2007 | Hiratsuka | |
| 2008/0087911 | A1 | 4/2008 | Stoyan | |
| 2009/0021936 | A1* | 1/2009 | Stimac et al. | 362/249 |
| 2009/0141477 | A1* | 6/2009 | Bhosale et al. | 362/95 |
| 2011/0075413 | A1* | 3/2011 | Smith et al. | 362/235 |

FOREIGN PATENT DOCUMENTS

| | | | |
|---|---|---|---|
| CN | 101255980 | A | 9/2008 |
| DE | 10306720 | B4 | 11/2005 |
| DE | 102006048230 | A1 | 4/2008 |
| EP | 1586810 | A2 | 10/2005 |

OTHER PUBLICATIONS

English language abstract for DE 10306720 B4, Nov. 6, 2009.
English language abstract of CN 101255980 A dated Sep. 3, 2008.

* cited by examiner

*Primary Examiner* — Mary McManmon

(57) ABSTRACT

A lighting module includes a base plate for fixing to a mounting surface, and a reflector body carrying a printed circuit board with one or more electrical light sources such as high power LEDs. The printed circuit board (includes electrical contact pins to the electrical light sources. The base plate and the reflector body are provided with complementary coupling formations for snap-like coupling the base plate and the reflector body with an electrical line interposed in between for feeding the light sources with the electrical contact pins electrically contacting the electrical line. The module may include force-generating formations to urge the printed circuit board against the base plate to promote heat transfer in between.

12 Claims, 3 Drawing Sheets

MOUNTING ARRANGEMENT FOR LIGHTING MODULES AND CORRESPONDING METHOD

CROSS-REFERENCES TO RELATED APPLICATIONS

This application claims the benefit of European Patent Application No. EP08168026, filed Oct. 31, 2008, the entire contents and disclosure of which are incorporated herein by reference.

TECHNICAL FIELD

This disclosure relates to mounting arrangements for lighting modules.

This disclosure was devised with specific attention paid to its possible application to mounting arrangements for arrays of high power LED modules.

BACKGROUND

When using conventional arrangements, realizing a circuit including an array of LED modules requires connecting multiple LED modules by means of cables and fasteners, which essentially involves a sequential procedure. Creating a pattern of LED modules thus requires locating every single module in place and then establishing electrical connections by cabling the modules one after the other. In the case of an array including, say, a number of modules equal to n, this involves n base plate placement operations, followed by n (if parallel) or n−1 (if series) electrical connection operations, and then n reflector placement operations.

A basic problem left unsolved by conventional arrangements as described in the foregoing is reducing the time devoted to installing multiple modules, especially the time spent for electrically connecting an array of high power LED modules, while also ensuring an easy handling pattern of light sources.

SUMMARY OF THE INVENTION

Various embodiments provide a simple and fast coupling connection process for LED modules while ensuring electrical connection and thermal dissipation.

Various embodiments are adapted to provide electrical connection in a single operation.

Various embodiments are adapted to provide "smart" replacement and good handling features.

BRIEF DESCRIPTION OF THE DRAWINGS

In the following description, various embodiments of the invention are described with reference to the following drawings, in which.

DETAILED DESCRIPTION OF ILLUSTRATIVE EMBODIMENTS

In the following description, numerous specific details are given to provide a thorough understanding of embodiments.

The embodiments can be practiced without one or more of the specific details, or with other methods, components, materials, etc. In other instances, well-known structures, materials, or operations are not shown or described in detail to avoid obscuring aspects of the embodiments.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

The embodiment illustrated in the figures aims at reducing the cost of the process and the number of components involved in producing a lighting source including a plurality of LED lighting modules 10. Each module 10 may in turn include one or more LED lighting sources such as a high-power LED lighting sources L (see FIG. 4). In an embodiment, each module 10 may include an array of say, two to four LED sources L.

The modules 10 (e.g. three of these modules 10, with reference to FIG. 1) are mounted on a common support surface (of any type: e.g. a lamp structure) 100.

Each module 10 (hereinafter, the modules 10 will be considered to be identical, so that only one of these will be described in detail) is mounted on the surface 100 via a (e.g. metallic—i.e. heat dissipative) base plate 102 in the form of a shaped body fixed to the surface 100. Fixing may be via screws 102*a* as shown or by any other means.

In an embodiment, the base plate 102 has a channel-like shape overall, including:

a flat web portion 1020 to lie flat against the surface 100, and two side portions 1022 to extend upwardly from the surface 100. The side portions 1022 have holes 1024, 1025 (or similar formations) for snap-in engagement of parts of the module 10 to be described in the following.

Figure 1:
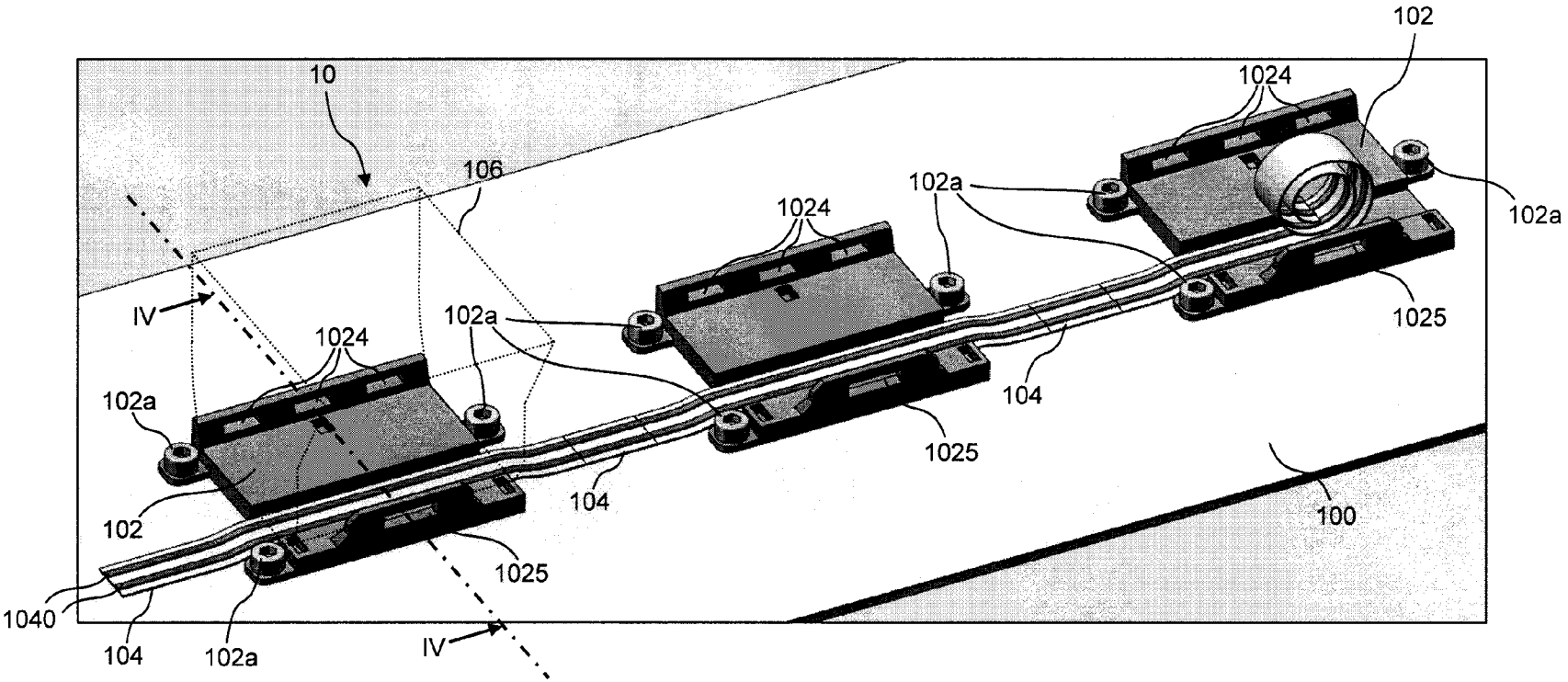
FIG. 1 is a general schematic view of an arrangement as described herein with certain parts omitted/shown in phantom lines.

Electrical connection of the various modules 10 is provided via a connector 104 in the form of e.g. a flexible ("flex") adhesive strip carrying e.g. two conductors 1040. As schematically shown in FIG. 1 (top right), such a strip 104 can be unwound and extended across a plurality of base plates 102 to rapidly provide stable electrical connection of the corresponding modules. This while also ensuring that all the modules 10 arranged on the surface 100 are connected with the same phase: this is ensured by the strip being flat, so that the electrical conductors therein maintain their mutual position provided the strip is not twisted.

Figure 4:
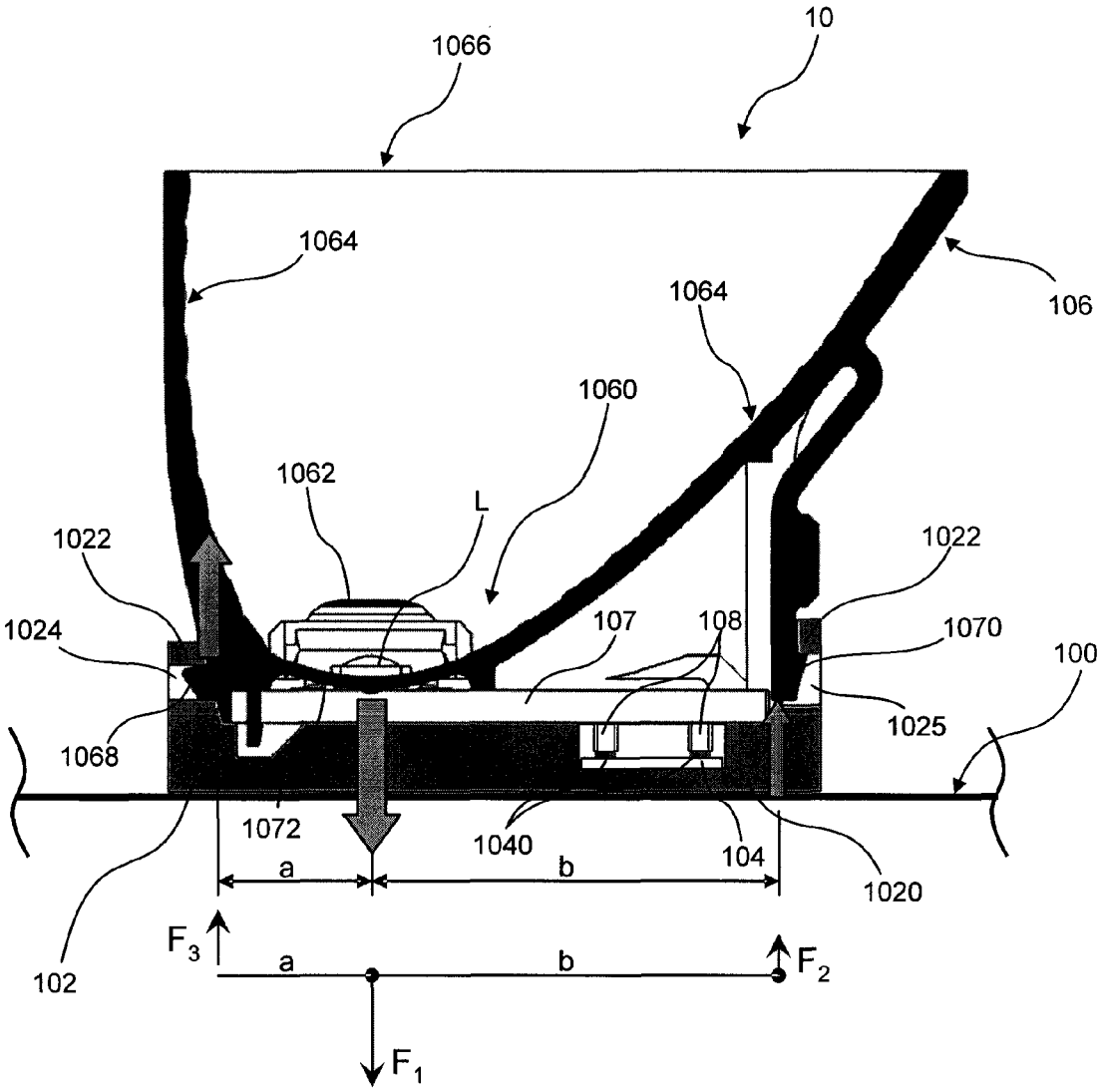
FIG. 4 is a cross-sectional view along line IV-IV of FIG. 1.

Both FIG. 1 and the cross sectional view of FIG. 4 show the strip 104 interposed between the base plate 102 and the body 106 of the module 10 (the body 106 of only one of the modules is illustrated in shadow lines in FIG. 1).

In the embodiment illustrated, the strip 104 is in fact interposed between the base plate 102 and a (e.g. metal core i.e. heat-dissipative) printed circuit board or PCB 107 carried by the body 106.

Figure 2:
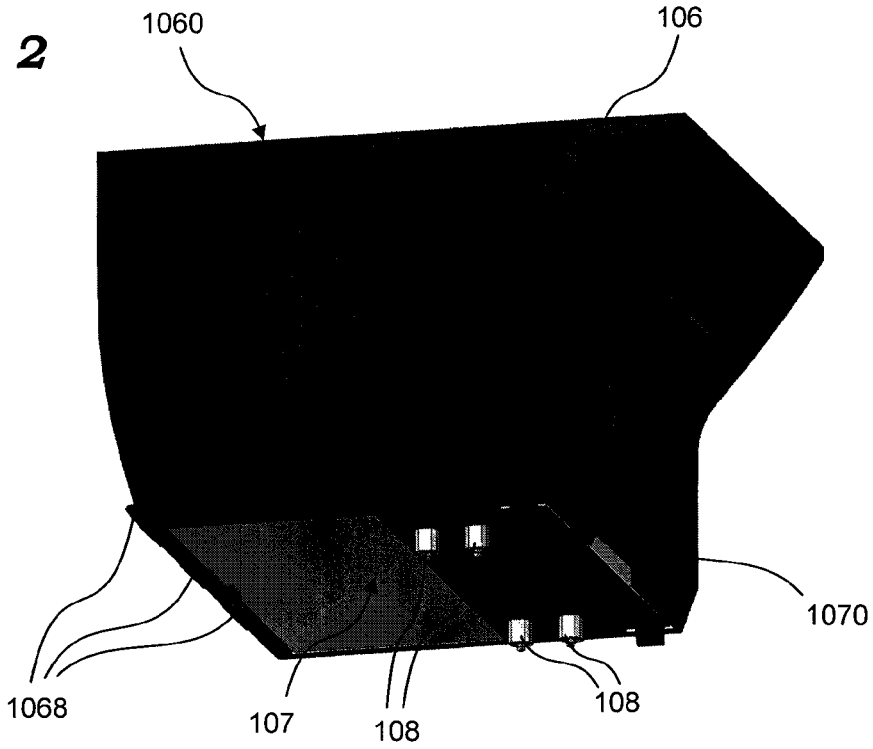
FIGS. 2 and 3 are perspective views of certain parts of the embodiment illustrated in FIG. 1.
Figure 3:
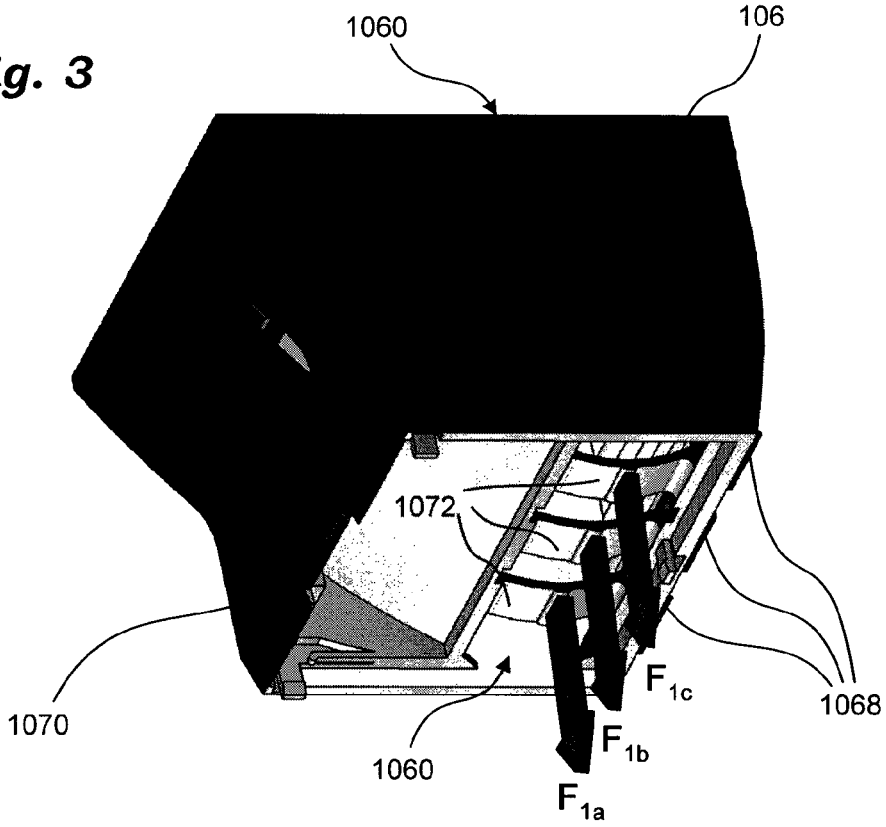

The PCB 107 carries the LED sources L at its upper side (i.e. the side "internal" to the body 106—see FIG. 4) and is provided at its lower side (i.e. the side "external" to the body 106—see FIG. 2) with contact pins 108 to contact the conductors 1040 in the strip 104.

In the embodiment illustrated, two pairs of contact pins 108 are provided for the LED sources L arranged in the body 106. In the embodiment illustrated, the contact pins 108 are in the form of spring-loaded pins adapted to contact the conductors 1040 by being pushed thereby against/into the PCB 107 that are mounted provided for two LED sources L arranged in the body 106.

Thermal coupling of the PCB 107 and the base plate 102 is increased by the mechanical action of the body 106, which also acts as a reflector, as better detailed in the following (e.g. by means of leaf springs that urge the PCB 107 against the base plate 102, possibly squeezing a TIM foil in between).

In the embodiment illustrated, the LED sources L and the pins 108 are carried by the PCB 107 at opposite sides thereof.

As best appreciated in the sectional view of FIG. 4, the body 106 is generally vat-shaped with a bottom portion 1060 provided with apertures for the LED sources L mounted on the PCB 107 and respective lenses 1062 associated therewith.

Further details of the mounting arrangement of the LED sources L and the lenses 1062 as well as the PCB 107 on the reflector body 106 can be found in a parallel application filed on even date by the same applicant.

The inner surface 1064 of the reflector body 106 is treated to be reflective (by known means, e.g. by being provided with reflective facets) and shaped (e.g. by having an at least approximately parabolic or paraboloid-like shape) to properly direct the light rays from the LED sources L (and especially the "outer" fraction of these light rays possibly escaping the focusing action of the lenses 1062) towards the distal opening 1066 of the reflector body 106 to be projected from the module 10.

Connection of the reflector body 106 with the base plate 102 is by snap-like engagement. To that effect, in the embodiment shown the reflector body 106 carries tooth formations adapted to engage the holes 1024, 1025 in the side portions 1022 of the base plate 102.

In the exemplary embodiment as illustrated, these tooth formations include a set of e.g. three teeth 1068 adapted to engage three corresponding holes 1024 in the side portion 1022 of the base plate 102 which is proximate to the LED sources.

Engagement of the teeth 1068 in the holes 1024 creates a sort of hinge-like coupling between the reflector body 106 and the base plate 102. The reflector body 106 can thus be rotated in a clamp-like fashion against the base plate 102 until a tooth 1070 provided at the opposite side of the reflector body 106 engages in a snap-like fashion a corresponding hole 1025 in the side portion 1022 of the base plate 102 which is proximate to the strip 104.

As a result of this snap-like engagement, the reflector body 106 is securely fixed the base plate 102 (and thus to the surface 100), with the strip 104 likewise securely clamped between the PCB 107 and the base plate 102 to provide electrical connection to the LED or LEDs in the module 10.

In the exemplary embodiment illustrated one or more spring-like formations 1072 are interposed between the reflector body 106 and the PCB 107 to urge the PCB 107 against the base plate 102 and provide good thermal coupling in between.

In the exemplary embodiment illustrated, these formations are in the form of arch-like leaf-springs extending between the LED sources. In an embodiment, these formations can be simply comprised of thin wall portions of the reflector body 106 extending between the openings for the light sources L provided in the "bottom" portion 1060.

The formations 1072 create a force system as shown in FIG. 4, by creating a force F1 which urges the PCB 107 towards the base plate 102 and corresponding reaction forces F2 and F3 acting on the side portions 1020 of the base plate 102. Specifically force F2 acts between the "locking" tooth 1070 and the corresponding opening 1025, while force F3 acts between the "hinge" teeth 1068 and the corresponding openings 1024.

Due to the lever effect thus created, this arrangement may produce a relevant force on the leaf springs 1072 even in the presence of a moderate reaction force at the "locking" tooth 1070. In fact:

$$\begin{cases} F_1 - F_2 - F_3 = 0 \\ F_1 \cdot a - F_2 \cdot (a+b) = 0 \Rightarrow F_2 \\ \qquad = F_1 \cdot \left(\frac{a}{a+b}\right) \end{cases}$$

$$\begin{cases} F_1 - F_2 - F_3 = 0 \Rightarrow F_1 - F_1 \cdot \left(\frac{a}{a+b}\right) \\ \qquad = F_3 \Rightarrow F_3 \\ \qquad = F_1 \cdot \frac{a+b-a}{a+b} \\ \qquad = F_1 \cdot \frac{b}{a+b} \\ F_1 \cdot a - F_2 \cdot (a+b) = 0 \Rightarrow F_2 \\ \qquad = F_1 \cdot \left(\frac{a}{a+b}\right) \end{cases} \Rightarrow \begin{cases} F_3 = F_1 \cdot \frac{b}{a+b} \\ F_2 = F_1 \cdot \frac{a}{a+b} \end{cases}$$

where a and b denote the distance of the point of action of the leaf springs 1072 to the teeth 1068 and the tooth 1070, respectively.

In fact, as the ratio "b/a" increases (i.e. as the leaf springs 1072 are arranged increasingly closer to the teeth 1068 than to the tooth 1070), the reaction force is increasingly supported by the rear teeth 1068, which explains why plural teeth may be used to distribute this reaction force.

Experiments carried out by the applicant indicate that good thermal coupling is achieved if the PCB 107 is urged against the base plate 102 with a force of 20N.

In an exemplary case: a=14 mm, b=37 mm $$\begin{aligned} F_3 &= 20 \cdot \frac{37}{37+14} \\ &= 14.5N \Rightarrow F_{3a} \\ &= F_{3b} \\ &= F_{3c} \\ &= \frac{F_3}{3} \\ &= \frac{14{,}5}{3} \\ &= 4{,}8N \end{aligned}$$

(single tooth force)

$$F_2 = 20 \cdot \frac{14}{37+14} = 5{,}5N$$

which is largely compatible with the embodiments described.

In an embodiment, an array of lighting modules 10 as described herein can be mounted on a mounting surface 100 by first mounting on that surface the base plates 102 of the modules.

The electrical line 104 is then extended (e.g. unwound) to connect said the base plates 102 already mounted on the mounting surface 100. The reflector bodies 106 of the modules 10, carrying the PCBs 107 with the LED sources are then mounted on the base plates 102 by snap-like coupling the reflector bodies 106 with the respective base plates 102 with the electrical line 104 interposed in between.

In an embodiment, the electrical line 104 is adhesively connected to the mounting surface 100.

Without prejudice to the underlying principles of the invention, the details and the embodiments may vary, even appreciably, with reference to what has been described by way of example only, without departing from the scope of the invention as defined by the annexed claims.

The invention claimed is:

1. A lighting module comprising: a base plate for fixing to a mounting surface; and a reflector body carrying a printed circuit board with at least one electrical light source, the printed circuit board comprising electrical contact pins to the at least one electrical light source; the base plate and the reflector comprising complementary coupling formations for snap-like coupling the base plate and the reflector body with an electrical line interposed in between for feeding the at least one electrical light source with the electrical contact pins electrically contacting the electrical line, and at least one force-generating formation configured to urge the printed circuit board against the base plate; wherein the complementary coupling formations comprises: at least one set of hinge-like coupling formations configured to establish a clamp-like coupling between the base plate and the reflector body, thereby permitting rotation of the reflector body against the base plate, and a set of locking formations configured to lock to the base plate the reflector body.

2. The lighting module of claim 1, wherein the at least one force-generating formation is arranged closer to the set of hinge-like coupling formations than to the set of locking formations.

3. The lighting module of claim 2, further comprising a plurality of sets of hinge-like coupling formations configured to provide a reaction force to the force produced by the force-generating formations.

4. The lighting module of claim 1, wherein the base plate further comprises:

a flat web portion, and two side portions extending channel-like from the web portion, wherein at least part of the complementary coupling formations configured to couple with the reflector body comprises the two side portions.

5. The lighting module of claim 4, wherein the two side portions comprise openings configured to couple with the reflector body.

6. The lighting module of claim 1, wherein the reflector body comprises teeth, wherein at least part of the complementary coupling formations configured to couple with the base plate comprises the teeth.

7. The lighting module of claim 1, wherein the at least one force-generating formation comprises at least one arch-like leaf-spring element of the reflector body.

8. The lighting module of claim 1, wherein the at least one electrical light source is an LED.

9. The lighting module of any of claim 1, wherein the electrical line is a flexible strip.

10. The lighting module of any of claim 1, wherein the electrical line is adhesively connected to the mounting surface.

11. A method of mounting on a mounting surface an array of lighting modules, the method comprising: providing a plurality of lighting modules, the lighting modules comprising: a base plate for fixing to a mounting surface; and a reflector body carrying .a.printed circuit board with at least one electrical light source, the printed circuit board comprising electrical contact pins to the at least one electrical light source; the base plate and the reflector comprising complementary coupling formations for snap-like coupling the base plate and the reflector body with an electrical line interposed in between for feeding the at least one electrical light source with the electrical contact pins electrically contacting the electrical line; mounting on the mounting surface the base plates of the plurality of lighting modules; extending the electrical line to connect the base plates of the plurality of lighting modules mounted on the mounting surface; and mounting on the base plates of the plurality of lighting modules mounted on the mounting surface the reflector bodies of the plurality of lighting modules, the reflector bodies carrying each a printed circuit board with at least one electrical light source, wherein the mounting the reflector bodies includes snap-like coupling the reflector bodies with respective base plates with the electrical line interposed in between; and providing at least one force-generating formation configured to urge the printed circuit board against the base plate; wherein the complementary coupling formations comprises: at least one set of hinge-like coupling formations configured to establish a clamp-like coupling between the base plate and the reflector body, thereby permitting rotation of the reflector body against the base plate, and providing a set of locking formations configured to lock to the base plate the reflector body.

12. The method of claim 11, further comprising adhesively connecting the electrical line to the mounting surface.

* * * * *

UNITED STATES PATENT AND TRADEMARK OFFICE

CERTIFICATE OF CORRECTION

PATENT NO. : 8,602,595 B2
APPLICATION NO. : 12/609024
DATED : December 10, 2013
INVENTOR(S) : Francesco Bianco et al.

It is certified that error appears in the above-identified patent and that said Letters Patent is hereby corrected as shown below:

On the title page, item (75) Inventors, delete "Blanco" and write "Bianco" in place thereof.

Signed and Sealed this
Twelfth Day of May, 2015

Michelle K. Lee

Michelle K. Lee
*Director of the United States Patent and Trademark Office*